US006116636A

United States Patent [19]

Bianchi Bazzi

[11] Patent Number: 6,116,636

[45] Date of Patent: Sep. 12, 2000

[54] BINDING WITH QUICK BOOT LOCKING ACTION PARTICULARLY FOR SNOWBOARDS

[75] Inventor: Giuseppe Bianchi Bazzi, Colico, Italy

[73] Assignee: Twinex S.r.l., Delebio, Italy

[21] Appl. No.: 08/951,372

[22] Filed: Oct. 16, 1997

[30] Foreign Application Priority Data

Oct. 22, 1996 [IT] Italy ..... MI96A2195

[51] Int. Cl.[7] ..... A63C 9/00

[52] U.S. Cl. ..... 280/624; 280/618

[58] Field of Search ..... 280/14.2, 617, 280/618, 623, 624, 625, 681, 632, 635

[56] References Cited

U.S. PATENT DOCUMENTS

| | | | |
|---|---|---|---|
| 4,489,956 | 12/1984 | Jungkind | 280/632 |
| 5,299,823 | 4/1994 | Glaser | 280/625 |
| 5,673,927 | 10/1997 | Vermillion | 280/611 |
| 5,690,351 | 11/1997 | Karol | 280/618 |
| 5,713,594 | 2/1998 | Jenni | 280/624 |
| 5,722,680 | 3/1998 | Dodge | 280/624 |
| 5,799,957 | 9/1998 | Okajima et al. | 280/14.2 |
| 5,871,226 | 2/1999 | Klubitschko et al. | 280/624 |
| 5,890,730 | 4/1999 | Anderson et al. | 280/624 |
| 5,957,480 | 9/1999 | Dodge | 280/624 |
| 5,971,422 | 10/1999 | Anderson et al. | 280/624 |
| 6,050,589 | 4/2000 | Couderc et al. | 280/624 |

FOREIGN PATENT DOCUMENTS

| | | |
|---|---|---|
| 90 11 109 | 10/1990 | WIPO . |
| 96 058 94 | 2/1996 | WIPO . |

*Primary Examiner*—Paul N. Dickson
*Assistant Examiner*—Daniel Yeagley
*Attorney, Agent, or Firm*—Guido Modiano; Albert Josif; Daniel O'Byrne

[57] ABSTRACT

A binding with quick boot locking action, particularly for snowboards, having a plate with a circular opening for engaging a disk for fixing to a snowboard. The binding is further provided, on the plate, with a quick coupling device acting laterally with respect to a counterplate which can be fixed to the sole of a boot and can be activated with an oscillation along an axis which is substantially parallel to the longitudinal extension of the sole.

14 Claims, 6 Drawing Sheets

BINDING WITH QUICK BOOT LOCKING ACTION PARTICULARLY FOR SNOWBOARDS

BACKGROUND OF THE INVENTION

The present invention relates to a binding with quick boot locking action, particularly for snowboards.

In snowboards the binding is conventionally constituted by a base plate to which a quarter is pivoted; said quarter has straps with buckles or the like for retaining the skier's boot.

The plate has a circular opening in which a disk engages; said disk allows to position the binding on the snowboard at different angles with respect to the longitudinal extension of the snowboard.

In the solutions of the prior art, therefore, in order to couple and release the binding of a snowboard it is necessary to perform a sequence of operations, since usually there are provided two or three straps that engage the boot at the foot region and at the quarter region.

Similar operations must furthermore be performed, obviously in reverse, during release.

SUMMARY OF THE INVENTION

The aim of the present invention is to solve the above problem, by providing a binding with quick locking action which allows to couple and release the boot with respect to the binding very quickly and without having to resort to closing buckles or the like.

Within the scope of this aim, a particular object of the present invention is to provide a binding in which it is possible to achieve a coupling which is stable and safe as well as free from plays of any kind.

Another object of the present invention is to provide a binding which, thanks to its particular constructive characteristics, is capable of giving the greatest assurances of reliability and safety in use.

Another object of the present invention is to provide a binding with quick locking action which can be easily obtained starting from commonly commercially available elements and materials and is also competitive from a purely economical point of view.

This aim, these objects and others which will become apparent hereinafter are achieved by a binding with quick boot locking action, particularly for snowboards, which comprises a plate with a circular opening for engaging a disk for fixing to a snowboard, characterized in that it comprises, on said plate, quick coupling means which act laterally with respect to a counterplate which can be fixed to the sole of a boot and can be activated with an oscillation along an axis which is substantially parallel to the longitudinal extension of said sole.

BRIEF DESCRIPTION OF THE DRAWINGS

Further characteristics and advantages of the present invention will become apparent from the following detailed description of a preferred but not exclusive embodiment of a binding with quick boot locking action, particularly for snowboards, illustrated only by way of non-limitative example in the accompanying drawings, wherein.

DESCRIPTION OF THE PREFERRED EMBODIMENTS

Figure 1:
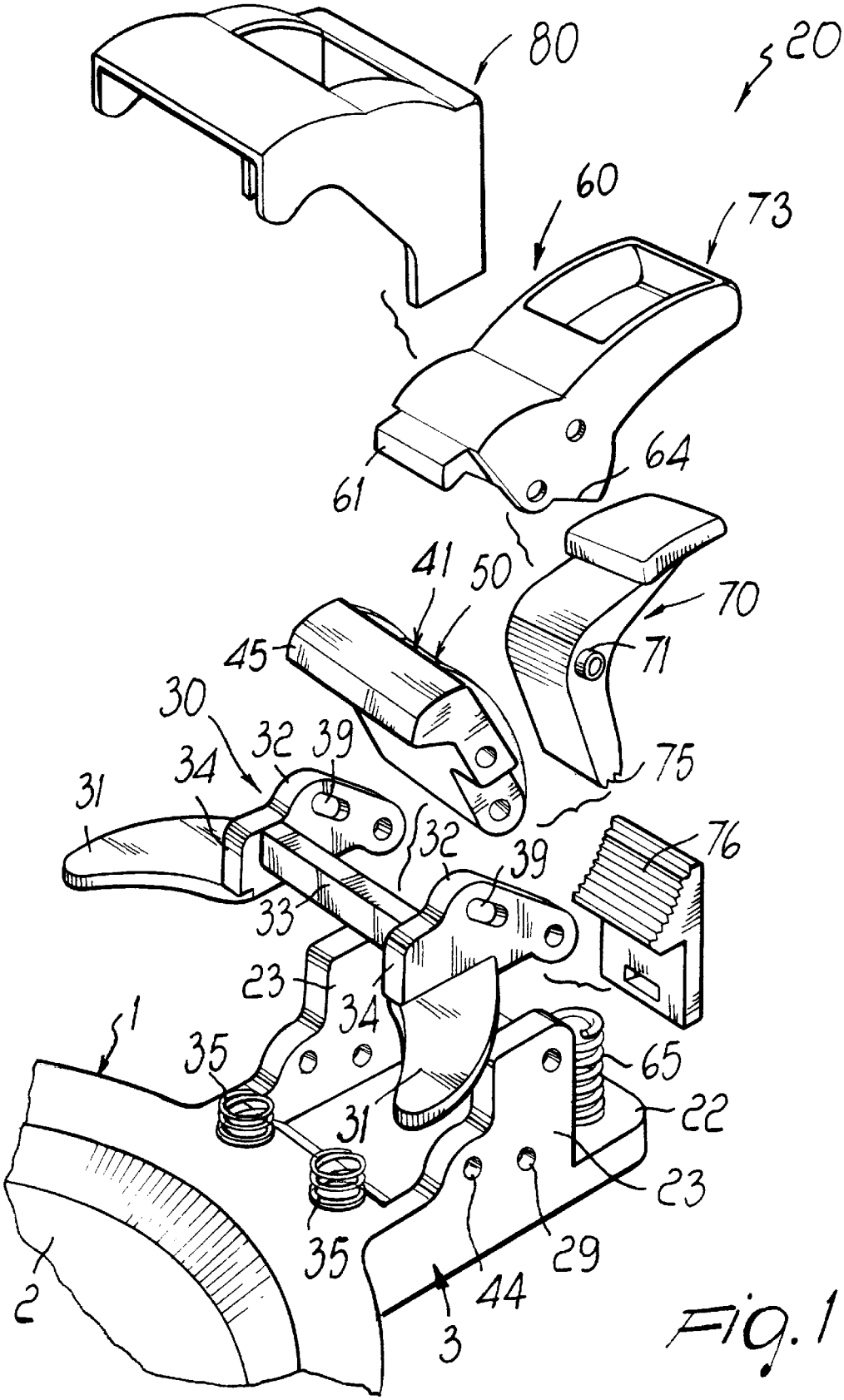
FIG. 1 is a schematic exploded perspective view of the binding according to the present invention.
Figure 3:
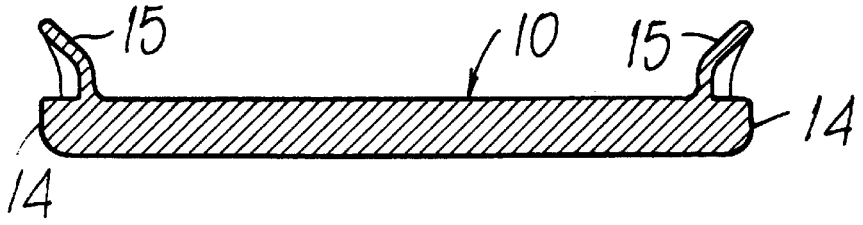
FIG. 3 is a sectional view, taken along the plane III—III of FIG. 2.
Figure 2:
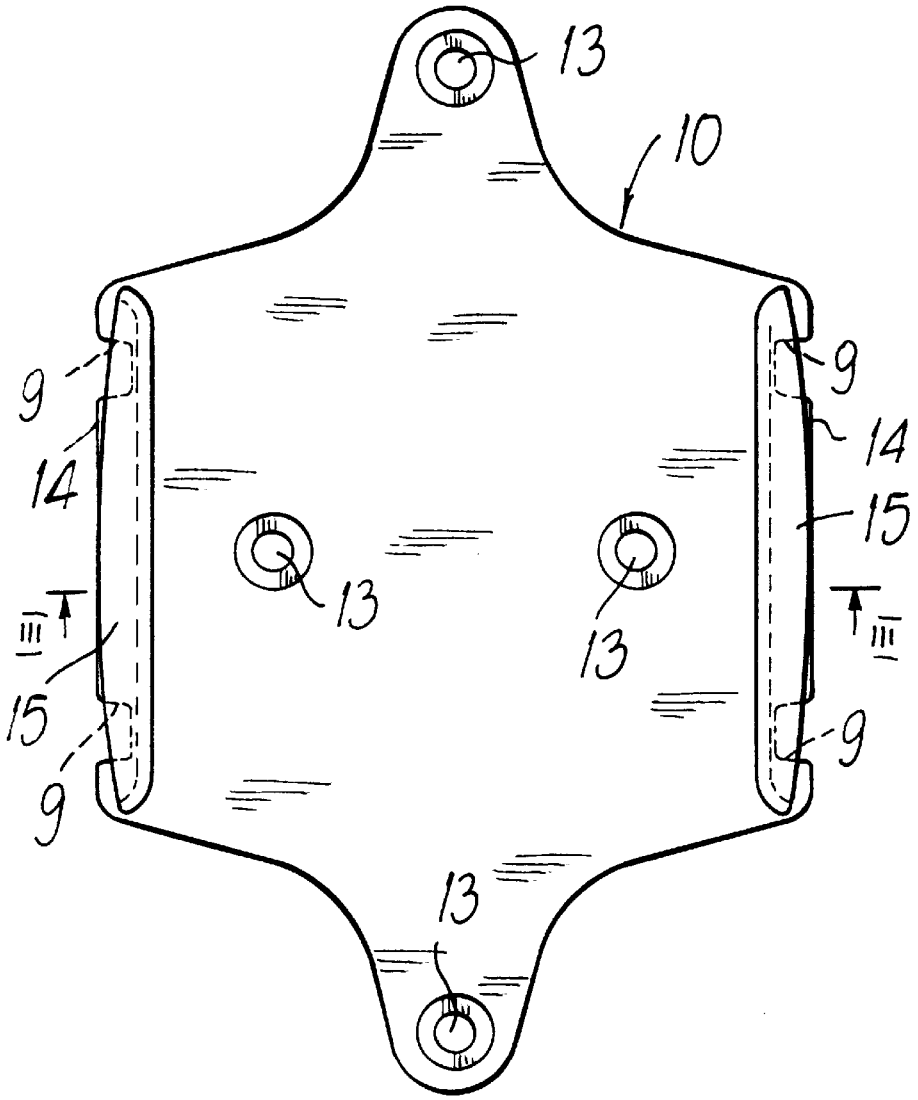
FIG. 2 is a plan view of the counterplate that can be applied to the sole of the boot.
Figure 7:
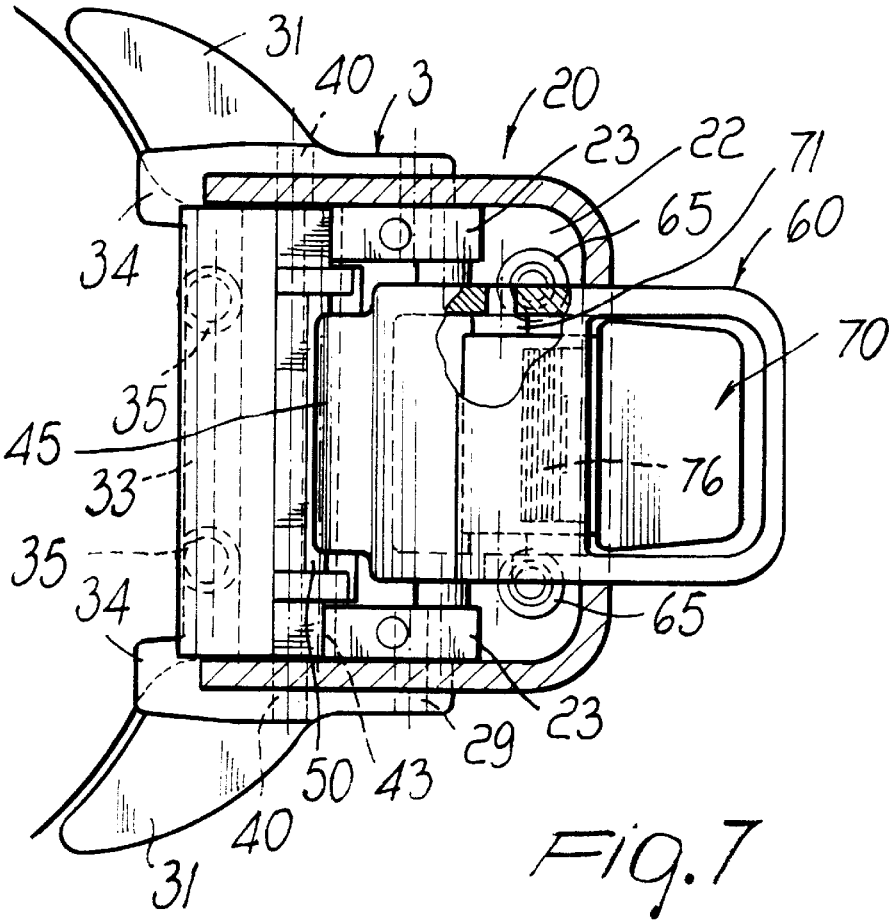
FIG. 7 is an enlarged-scale top plan view of the coupling means.
Figure 4:
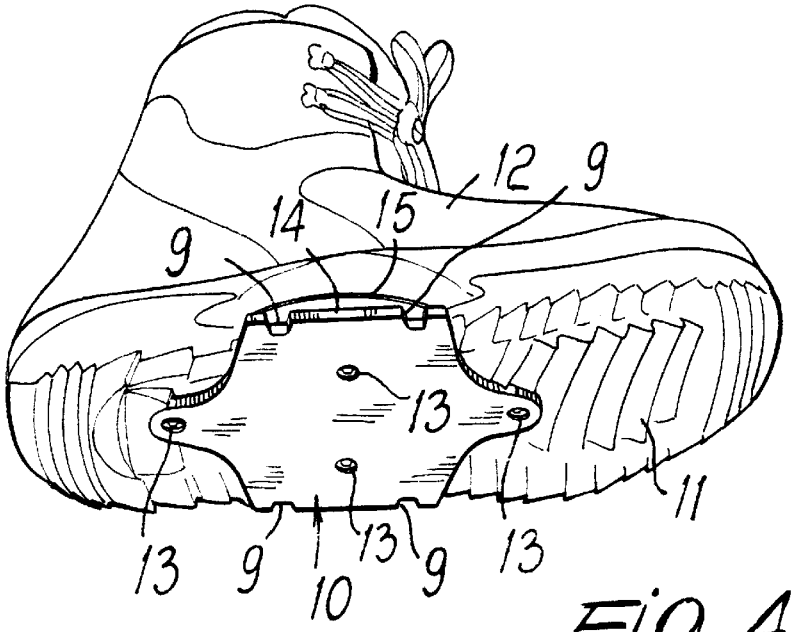
FIG. 4 is a schematic view of a shoe, seen from the sole in order to illustrate the placement of the counterplate.
Figure 5:
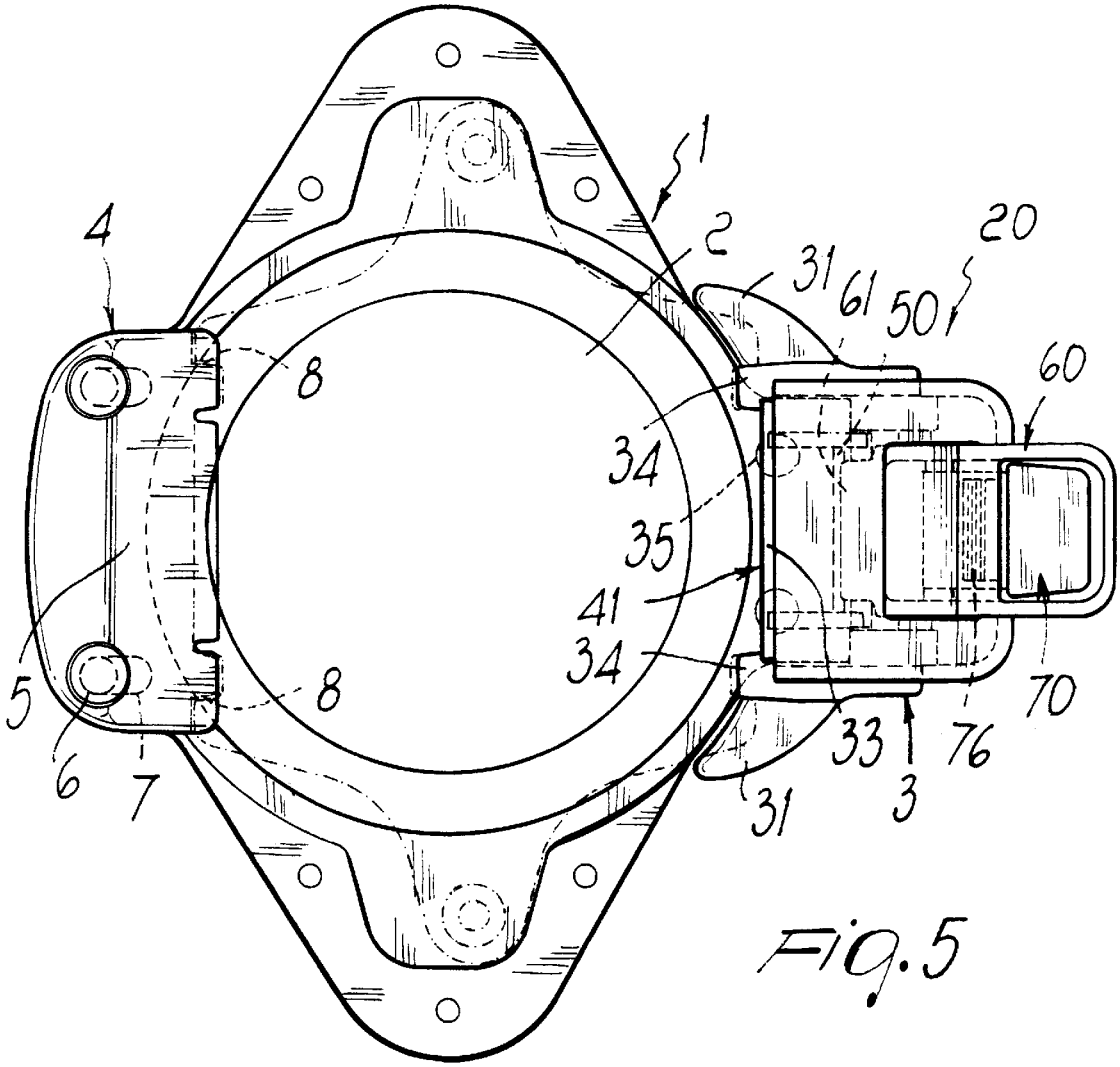
FIG. 5 is a top plan view of the plate with the circular opening.
Figure 6:
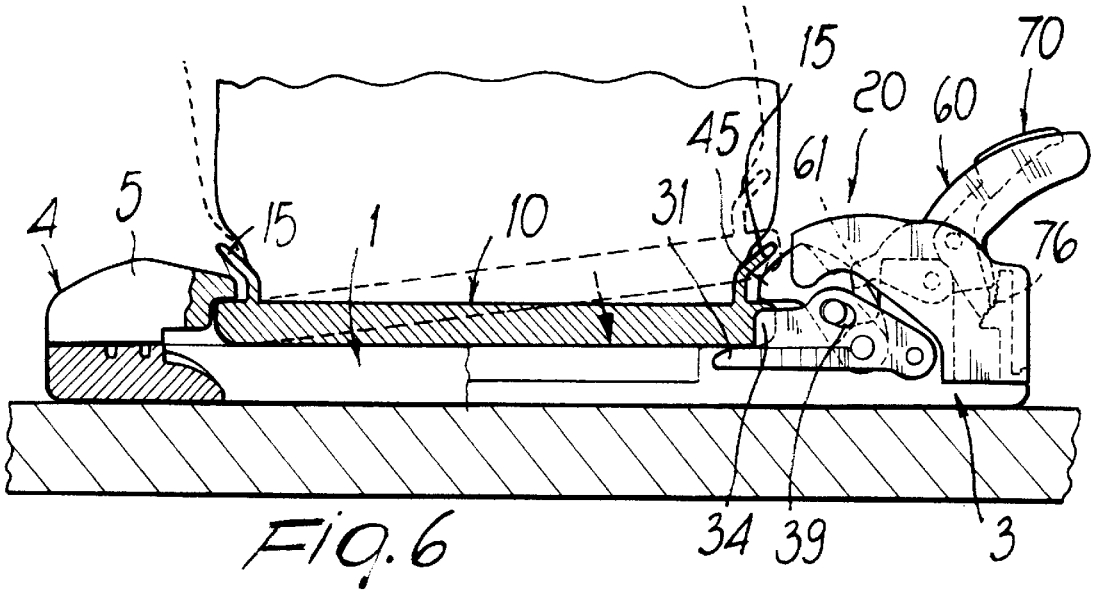
FIG. 6 is a schematic view of the fixing of the counterplate performed by the coupling means.

With reference to the above figures, the binding with quick boot locking, particularly for snowboards, according to the present invention, comprises a base plate, generally designated by the reference numeral 1, which is provided with the typical circular opening 2 in which the fixing disk engages; said fixing disk is not shown in the accompanying drawings and allows to connect the base plate to the snowboard with the chosen angle.

The base plate 1 forms, in a lateral median portion, a support which is generally designated by the reference numeral 3 and is arranged diametrically opposite, relative to the opening 2, to an abutment generally designated by the reference numeral 4.

In greater detail, the abutment 4 is constituted by a secondary plate 5 which can be connected to the base plate 1 by means of screws 6 which engage elongated slots 7, so that it is possible to adjust the distance with respect to the diametrically opposite support.

The secondary plate 5 is provided with frustum-shaped centering protrusions 8 which engage corresponding frustum-shaped seats 9 formed on a counterplate, generally designated by the reference numeral 10, which can be fixed below the sole 11 of a boot, generally designated by the reference numeral 12. The coupling between the protrusions 8 and the frustum-shaped seats 9 performs the important function of allowing very easy positioning of the counterplate, and therefore of the boot, on the binding for quick and easy coupling of the boot.

The counterplate 10 is provided with fixing holes 13 which are arranged in a quadrilateral pattern in order to allow uniform stress distribution.

At the lateral edges 14, where the frustum-shaped seats 9 are formed, there are also provided protective flaps 15 which protrude from the plane formed by the counterplate in order to substantially engage the lateral edges of the boot, so as to act as a protective element and better delimit the region where the counterplate 10 engages the support 3 and the quick coupling means, generally designated by the reference numeral 20, which act diametrically with respect to the abutment 4.

Figure 10:
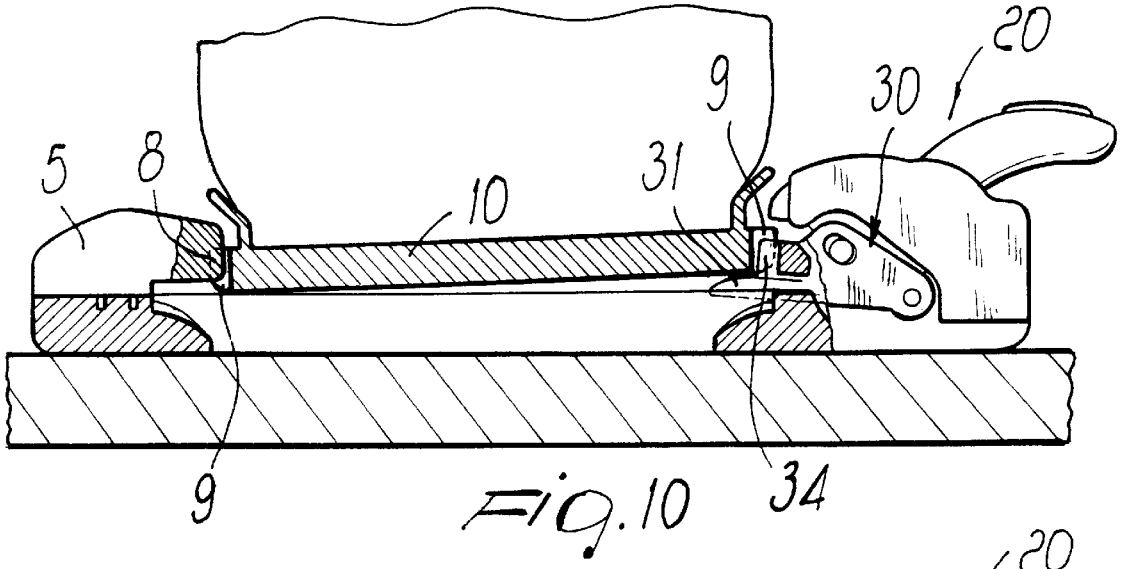
FIG. 10 is a sectional view, taken at the frustum-shaped seats, of the initial step for the coupling of the counterplate.
Figure 11:
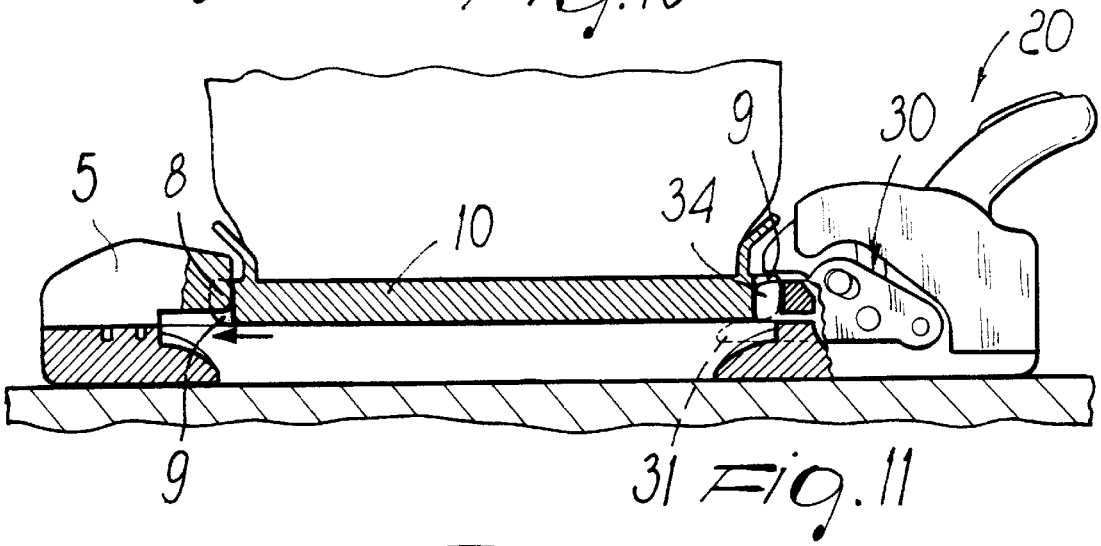
FIG. 11 is a view of the coupling, illustrating the lateral compression.
Figure 12:
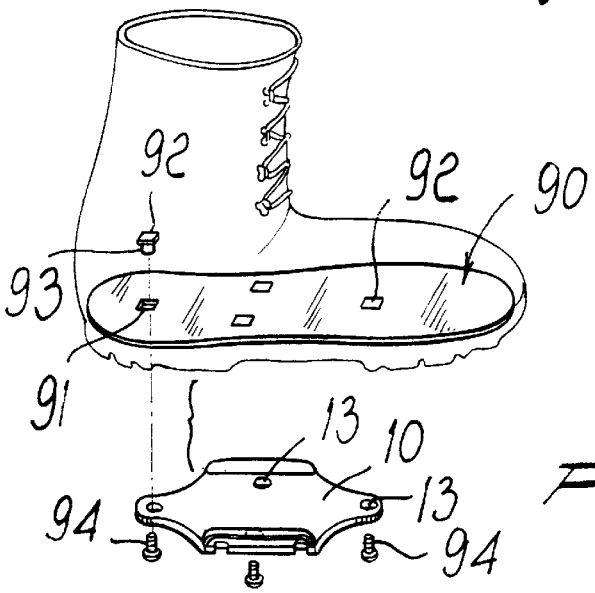
FIG. 12 is an exploded view of the counterplate fixing means.

The quick coupling means are connected at the support 3, which forms a base 22 from which side walls 23 protrude; said side walls act as a support for an actuation lever, generally designated by the reference numeral 30, which is pivoted at seats 29 to the side walls so that it can oscillate. The actuation lever 30 is provided with lateral protrusions 31 which extend from the sides 32, which are connected by a cross-member 33 and have, at their free end, an insertion end 34 which enters the frustum-shaped seats 9 of the counterplate 10. During insertion, as shown more clearly in FIGS. 10 and 11, the insertion of the ends 34 in the seats 9 generates a lateral compression which reduces the plays in the coupling of the seats 9 of the counterplate 10 with the protrusions 8 on one side and with the ends 34 on the other side, increasing the rigidity of the system.

Pusher springs 35 act on the cross-member 33 and abut, at their other end, against the base of the support 3 in order to keep the lever in raised position with respect to the base plate in the inactive condition.

The sides 32 form elongated slots 39 for engaging a pin 40 which is supported in a median portion of a locking pawl 41 which oscillates, at one of its ends, with respect to a pivot 43 which can rotate with respect to seats 44 of the side walls 23 and forms, at its other end, a pawl-shaped tooth 45 which can be inserted above the counterplate 10 in the region delimited by the flap 15 in order to push it into the locking position.

On the side opposite to the one provided with the pawl-shaped tooth 45, the locking pawl 41 has a tooth-shaped protrusion 50 which forms an abutment portion 50*a* directed upward and an inclined blending portion 50*b* directed toward the pivoting point.

A locking lever, generally designated by the reference numeral 60, engages the back of the locking pawl 41 and is pivoted to the side walls 23; said lever forms a locking tooth 61 which, when the quick coupling means are open, couples to the abutment portion 50*a* of the tooth 50. The locking lever 60, on the opposite side with respect to the locking tooth 61, has tabs 64 against which locking springs 65 act; said springs abut against the base 22 and keep the locking lever pressed against the pawl in order to make the locking tooth 61 engage the blending portion 50*b* when the locking pawl has fastened onto the counterplate, thus keeping it locked by pushing.

Inside the locking lever there is provided a safety lever, designated by the reference numeral 70, which is pivoted in a median portion 71 to the side walls of the locking lever and has a button-shaped portion 72 which protrudes into an opening 73 formed by the locking lever and has, at the other end, a toothed end 75 which engages a wedge abutment 76 for the safety lever 70 which is rigidly associated with the support 20 in order to prevent the accidental rotary actuation of the locking lever 60 if the safety lever 70 has not been actuated first by acting on its button-shaped portion 72 in contrast with a contrast spring 78.

The assembly is completed by a covering fairing 80 which covers the entire part of the mechanisms.

It should be added to the above that in order to couple the counterplate to the boot there is provided a complementary counterplate 90 which is arranged inside the boot and has rotation-preventing impressions 91 in which corresponding flanges 92 of bushes 93 enter; the screws 94 that enter the holes 13 of the counterplate 10 engage in said bushes.

In practical operation, the quick coupling means act laterally in order to engage the counterplate that is fixed below the sole and are actuated by means of an oscillation along an axis which is substantially parallel to the longitudinal extension of the sole.

More specifically, in order to lock the binding it is sufficient to position the shoe on the binding; one is assisted in this operation by the insertion of the frustum-shaped seats 9 of the counterplate 10 on the frustum-shaped abutments 8 formed by the secondary plate 5.

Figure 8:
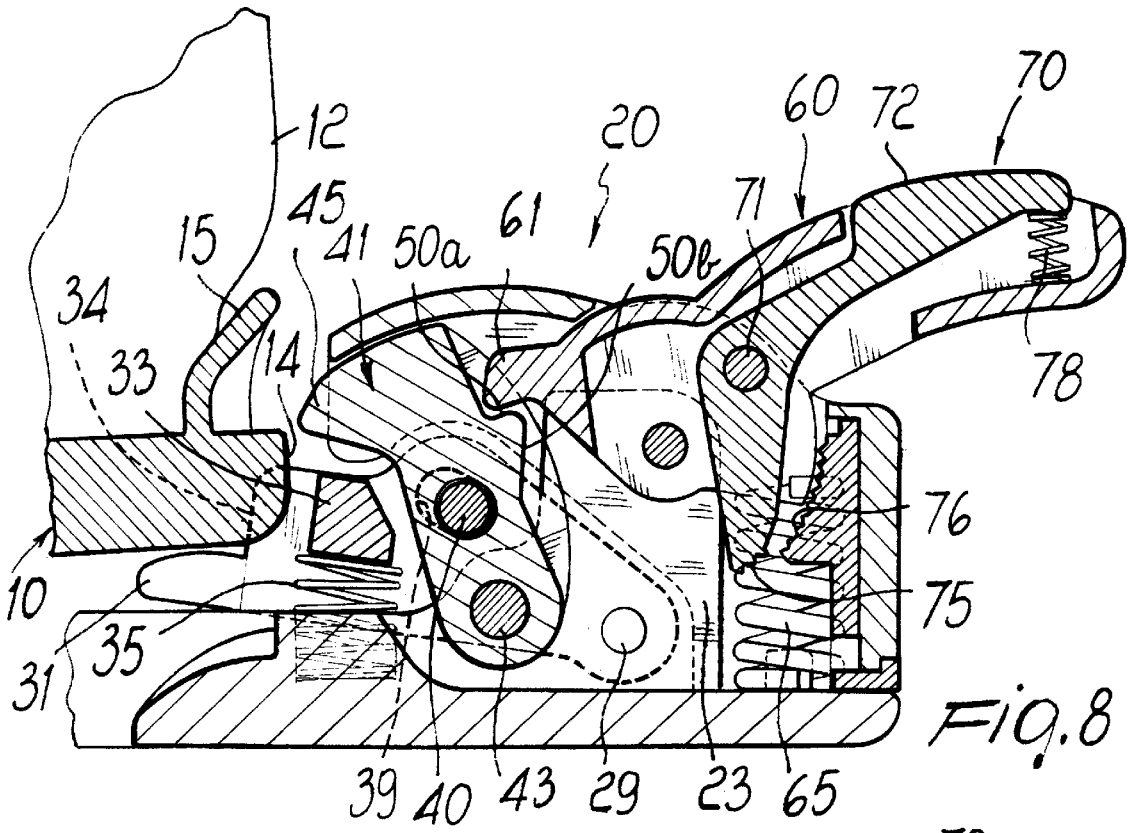
FIG. 8 is a sectional view of the coupling means before the coupling of the counterplate.
Figure 9:
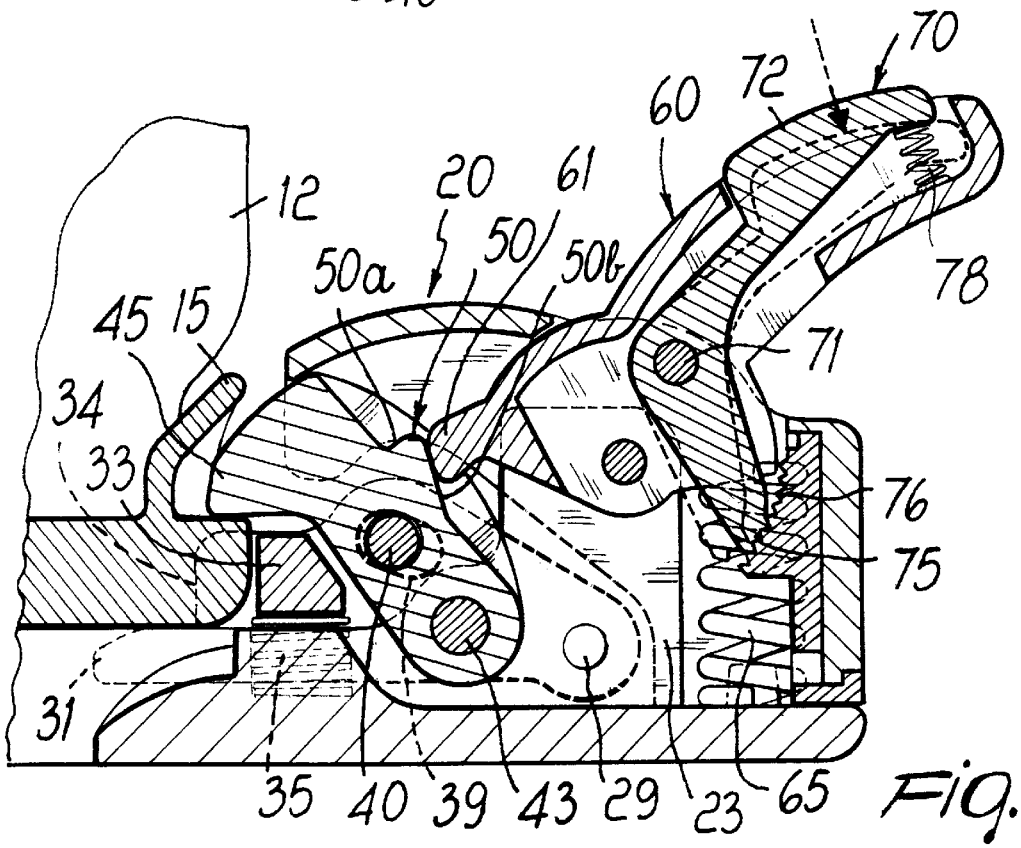
FIG. 9 is a sectional view of the quick coupling means coupled to the counterplate.

Then, as shown in FIG. 8, the counterplate 10 is arranged below the secondary plate 5, while it rests above the protrusions 31 of the actuation lever.

By applying compression to the actuation lever, by means of the thrust applied by the counterplate to the protrusions, the actuation lever 30 is caused to rotate counterclockwise, with respect to the drawings, and draws, during its rotation, the locking pawl by means of the pin 40 that slides in the slots 39.

During this step, the insertion of the ends 34 in the seats 9 through the rotation of the lever 30 causes a lateral compression, tightening the counterplate 10 against the protrusions 8 and fully eliminating plays.

The locking pawl is then rotated counterclockwise, with reference to the drawings, until its pawl-shaped portion engages below the flap 15, locking the counterplate.

Simultaneously, the rotation of the pawl-shaped lever causes the tooth 61 of the locking lever, which was previously engaged with the abutment portion 50*a* of the abutment 50, to engage the blending portion 50*b*, applying a further thrust.

Moreover, the rotation of the locking lever causes the rotation of the safety lever, which makes the toothed portion 75 engage the abutment 76 for the safety lever, so that locking against accidental openings is achieved.

In order to release the binding it is necessary to first of all act on the safety lever at its button-shaped portion 72, so as to move the set of teeth 75 away from the abutment; it is then possible to rotate the locking lever clockwise, with reference to the drawings, so that the tooth 61 disengages from the blending portion 50*b* and the locking pawl, pushed by the actuation lever, turns clockwise with reference to the drawings, consequently releasing the counterplate 10.

From the above description it is thus evident that the invention achieves the intended aim and objects and in particular the fact is stressed that a binding with quick boot locking action is provided which allows to perform automatic coupling with a very simple movement, constituted by a rotation about an axis which is longitudinal with respect to the sole, in order to achieve the automatic intervention of the coupling, so that the boot is stably coupled to the binding without having to perform other operations.

Another important aspect is also constituted by the fact that the release operations are equally simple, although providing safety against accidental openings, since it is necessary to act first on a safety lever which is accommodated inside the locking lever.

The invention thus conceived is susceptible of numerous modifications and variations, all of which are within the scope of the inventive concept.

All the details may also be replaced with other technically equivalent elements.

In practice, the materials employed, as well as the contingent shapes and dimensions, may be any according to requirements.

What is claimed is:

1. A binding with quick locking action, for securing a boot with a sole on a snowboard, the binding comprising:

a base plate with a circular opening;

a disk for fixing to a snowboard engageable in said circular opening;

a counterplate which is fixable to the boot sole;

a quick coupling means comprising a locking pawl, a support having a base and side walls and a quick coupling actuation lever having sides, wherein said quick coupling actuation lever sides have elongated slots for engaging a pin which is supported in a median portion of the locking pawl, said locking pawl being pivoted to said side walls of said support and having a pawl shaped tooth being insertable above said counterplate in a region delimited by a protection flap protruding at a lateral edge of said counterplate from a plane formed by said counterplate;

an abutment arranged laterally on said base plate for releasably engaging a first side of said counterplate;

said quick coupling actuation lever pivotally arranged laterally on said base plate diametrically opposite said abutment with respect to said circular opening of said base plate for releasably engaging a second side of said counterplate;

a pair of mutually distally arranged frustum-shaped centering protrusions of said abutment each having a pair of sides which converge in a direction extending towards the inside of said base plate and parallel to said diametrically opposite direction;

a first pair of mutually distally arranged frustum-shaped centering seats formed at said first side of said counterplate and shaped correspondingly to said pair of frustum-shaped centering protrusions;

a pair of mutually distally arranged frustum-shaped insertion ends of said quick coupling actuation lever each having a pair of sides which converge in a direction extending towards the inside of said base plate and parallel to said diametrically opposite direction;

a second pair of mutually distally arranged frustum-shaped centering seats formed at said second side of said counterplate and shaped correspondingly to said pair of frustum-shaped insertion ends;

whereby in a locking position of the binding said pair of centering protrusions engage in said first pair of centering seats, and said pair of insertion ends engage in said second pair of centering seats, for generating lateral compression on said counterplate for eliminating coupling plays.

2. A binding according to claim 1, further comprising:

a complementary counterplate which is insertable in said boot;

rotation-preventing recesses formed on said complementary counterplate;

bushes provided with engagement flanges; and screws which pass through holes formed on said counterplate, for engaging said bushes with said rotation-prevention recesses engaging said flanges.

3. A binding according to claim 1, wherein said counterplate is provided with holes for fixing to said sole, said holes being arranged in a quadrilateral pattern on said counterplate in order to distribute occurring stresses.

4. A binding according to claim 3, wherein said counterplate has, at lateral edges thereof, protection flaps, said protection flaps protruding from a plane formed by said counterplate.

5. A binding according to claim 1, wherein said abutment and said quick coupling means is in a diametrical position with respect to said circular opening.

6. A binding according to claim 5, further comprising a fairing which is arranged so as to cover the quick coupling means supported by said support.

7. A binding according to claim 5, wherein said abutment comprises a secondary plate which is fixable to said base plate through adjusting means for distance adjustment with respect to said support.

8. A binding according to claim 5, wherein said quick coupling means comprises:

said side walls protruding from said base of said support;

said quick coupling actuation lever being pivoted to said side walls;

a locking pawl kinematically connected to said quick coupling actuation lever, and a locking lever acting on said locking pawl.

9. A binding according to claim 8, wherein said quick coupling actuation lever comprises:

lateral protrusions protruding from said sides of said quick coupling actuation lever;

a cross-member joining said lever sides; and pusher springs acting between said cross-member and said base of the support.

10. A binding according to claim 9, wherein said lateral protrusions of said quick coupling actuation lever have, at free ends thereof, said insertion ends.

11. A binding according to claim 10, wherein said locking pawl has:

on an opposite side with respect to said pawl-shaped tooth, a tooth-shaped protrusion which forms an abutment portion, said abutment portion being directed upwards; and an inclined blending portion which is directed towards a pivoting point of said locking pawl, said locking lever acting at said tooth-shaped protrusion.

12. A binding according to claim 11, wherein said locking lever is pivoted to said side walls of said support and has a locking tooth, said locking tooth being coupleable to said abutment portion of said locking pawl, when the quick coupling means are in an open position, and with said inclined blending portion, when the quick coupling means are in the locking position.

13. A binding according to claim 12, wherein said locking lever has lateral tabs and locking springs, said locking springs acting between said lateral tabs and said base of said support.

14. A binding according to claim 13, said quick coupling means further comprising:

a safety lever located inside said locking lever, said safety lever being pivoted in a median portion thereof to side walls of said locking lever;

a button-shaped portion provided at a first end of said safety lever, said button-shaped portion protruding through an opening formed on an actuation end of said locking lever;

a toothed end provided at a second end of said safety lever; and wedge abutment rigidly associated with said support, said toothed end being detachably coupled against said wedge abutment, and a contrast spring acting between said button-shaped portion and said locking lever.

* * * * *